United States Patent [19]

Shiotani

[11] Patent Number: 4,630,745

[45] Date of Patent: Dec. 23, 1986

[54] FOLDABLE CONTAINERS

[75] Inventor: Yosuke Shiotani, Komaki, Japan

[73] Assignee: Kunimori Kagaku Co., Ltd., Aichi, Japan

[21] Appl. No.: 711,412

[22] Filed: Mar. 13, 1985

[30] Foreign Application Priority Data

Apr. 13, 1984 [JP] Japan ..... 59-55337[U]
Sep. 5, 1984 [JP] Japan ..... 59-135293[U]
Nov. 22, 1984 [JP] Japan ..... 59-177964[U]

[51] Int. Cl.[4] ..... B65D 6/18; B65D 6/26

[52] U.S. Cl. ..... 220/6; 220/4 F; 217/15; 217/47

[58] Field of Search ..... 220/6, 7, 4 F, 83, 84; 217/15, 47

[56] References Cited

U.S. PATENT DOCUMENTS 1,064,328 6/1913 Howell ..... 217/15
1,819,735 8/1931 Cook ..... 220/6
2,755,955 7/1956 Gordon ..... 220/6
3,334,175 8/1967 Vincent ..... 220/84
3,405,835 10/1968 Eby ..... 220/4 F
3,796,342 3/1974 Sanders ..... 220/7
3,870,185 3/1975 Sanders ..... 220/6
3,966,285 6/1976 Porch ..... 220/4 F
4,300,695 11/1981 Hsu ..... 220/7

FOREIGN PATENT DOCUMENTS 1289014 9/1972 United Kingdom ..... 220/84

*Primary Examiner*—George E. Lowrance
*Attorney, Agent, or Firm*—Frishauf, Holtz, Goodman & Woodward

[57] ABSTRACT

A foldable container includes an upper rectangular frame; a rectangular bottom plate having studs insertable into opposing sides of said upper frame; a pair of side plates, the upper end of each side plate being rotatably connected to said frame while the lower end is detachably engagable with said bottom plate; and a pair of end plates, the upper end of each end plate being detachably engagable with said frame while the lower end is detachably engageable with the studs of the bottom plate.

5 Claims, 12 Drawing Figures

FOLDABLE CONTAINERS

BACKGROUND OF THE INVENTION

This invention relates to a foldable container utilized for transporting various goods.

A prior art foldable container disclosed in Japanese Laid-open Utility Model Nos. 36350/1980 and 4596/1981 comprises a frame, a bottom plate, foldable side plates rotatably connected to both the frame and bottom plate and end plates rotatably supported by the frame. At the time of assembling, while maintaining the frame and the bottom plate separated away, two folded side plates are brought to vertically straight positions, and the end plates are rotated toward the bottom plate so as to cause the lower ends of the end plates to engage with the bottom plate. When folding such a container, the engagement between the lower ends of the end plates and the bottom plate is released, the end plates are rotated inwardly and the side plates are folded thereby integrating the frame and the bottom plate.

However, in the foldable container of the type described above, since the side plates which are supported to be rotatable or foldable with respect to the frame and the bottom plate are foldably prepared, the folding plates are complicated and require a number of component parts, thus increasing cost and reducing productivity. Moreover, as the side plates are folded, their thickness increases so that the thickness of the folded container increases, whereby, when a number of folded containers are piled up, the height of the pile increases.

SUMMARY OF THE INVENTION

Accordingly, it is an object of this invention to provide an improved foldable container that can readily be assembled and folded, and can be manufactured at a low cost and high productivity.

Another object of this invention is to provide an improved foldable container capable of reducing the height thereof, thereby increasing the efficiency of piling up.

A further object of this invention is to provide an improved foldable container capable of reducing the weight thereof.

According to this invention, there is provided a foldable container comprising an upper rectangular frame;

a rectangular bottom plate having studs insertable into opposing sides of said upper frame;

a pair of side plates, the upper end of each of said side plates being rotatably connected to said frame while the lower end thereof being detachably engagable with said bottom plate; and a pair of end plates, the upper end of each of said end plates being detachably engagable with said frame while the lower end thereof being detachably engagable with said studs of said bottom plate.

DESCRIPTION OF THE PREFERRED EMBODIMENT

Figure 1:
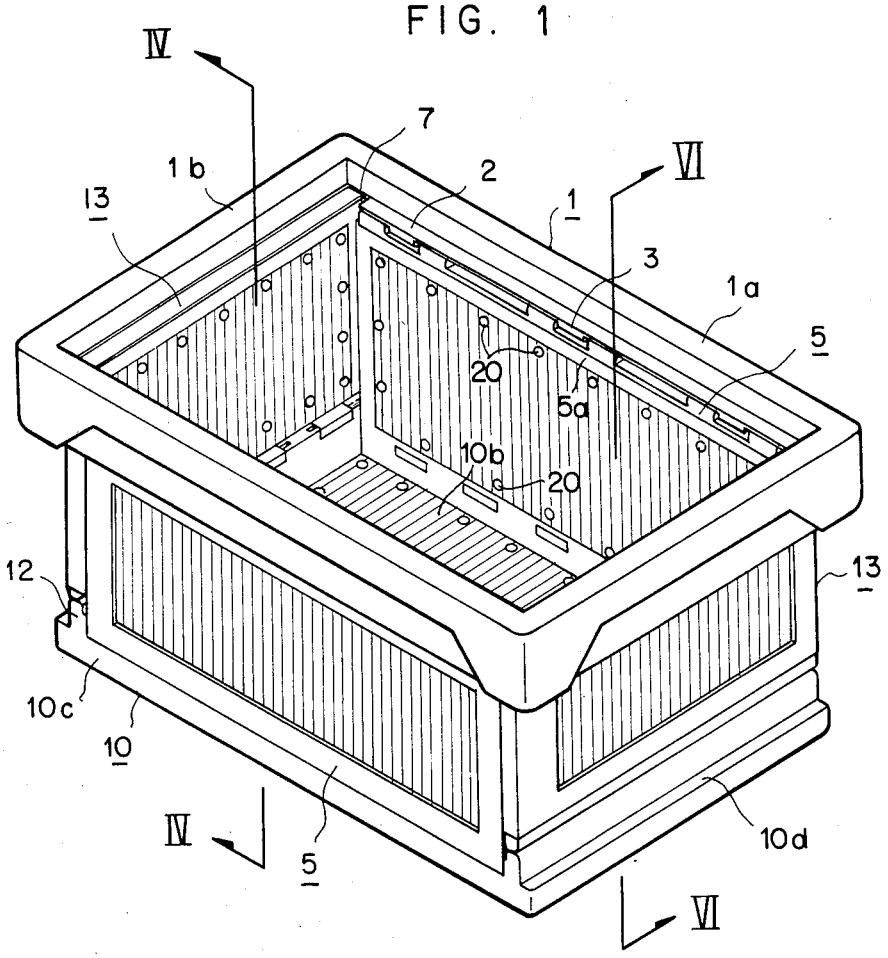
FIG. 1 is a perspective view showing one example of a foldable container embodying the invention.
Figure 2:
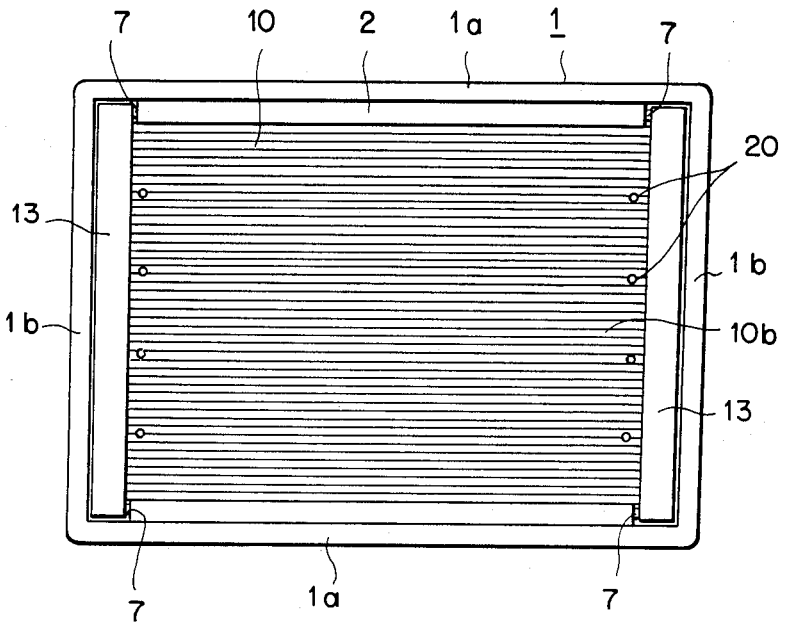
FIG. 2 is a plan view thereof.
Figure 3:
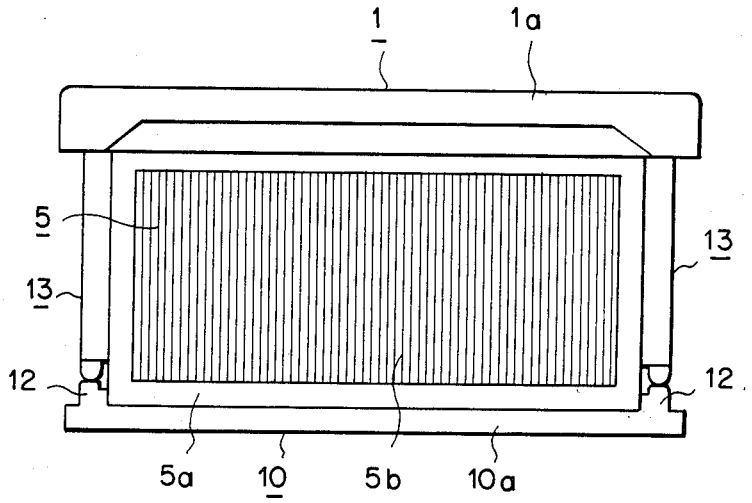
FIG. 3 is a front view thereof.

As shown in FIGS. 1 through 3, a foldable container embodying the invention comprises a rectangular upper frame 1, a pair of side plates 5·5, a pair of end plates 13·13, and a bottom plate 10, all of which are made of synthetic resins such as polypropylene resin or ABS resin.

Figure 5:
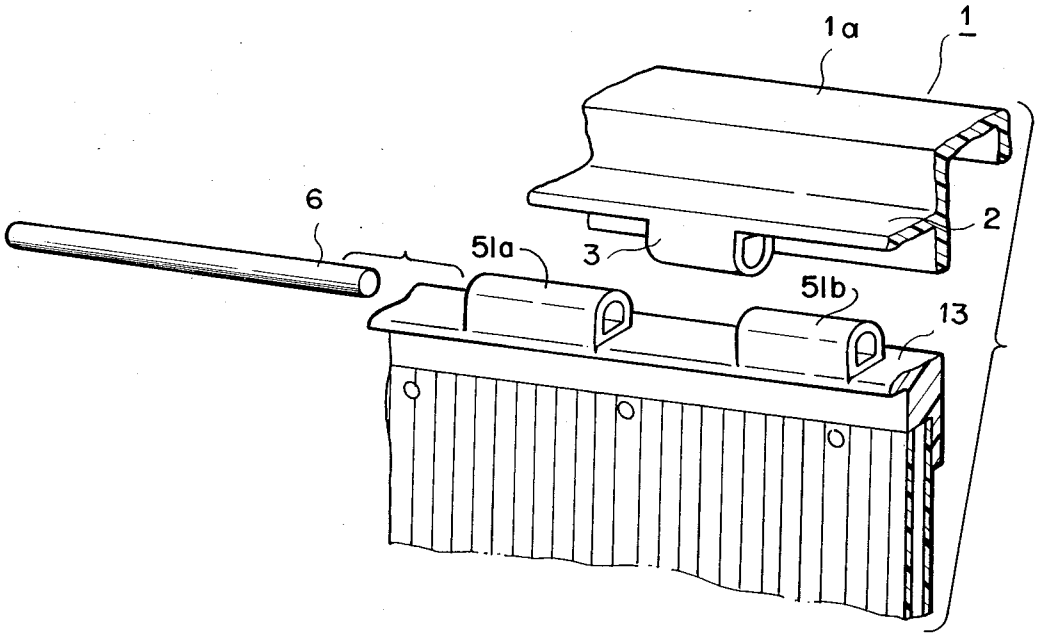
FIG. 5 is an exploded perspective view showing the relation of a frame and an end plate.
Figure 6:
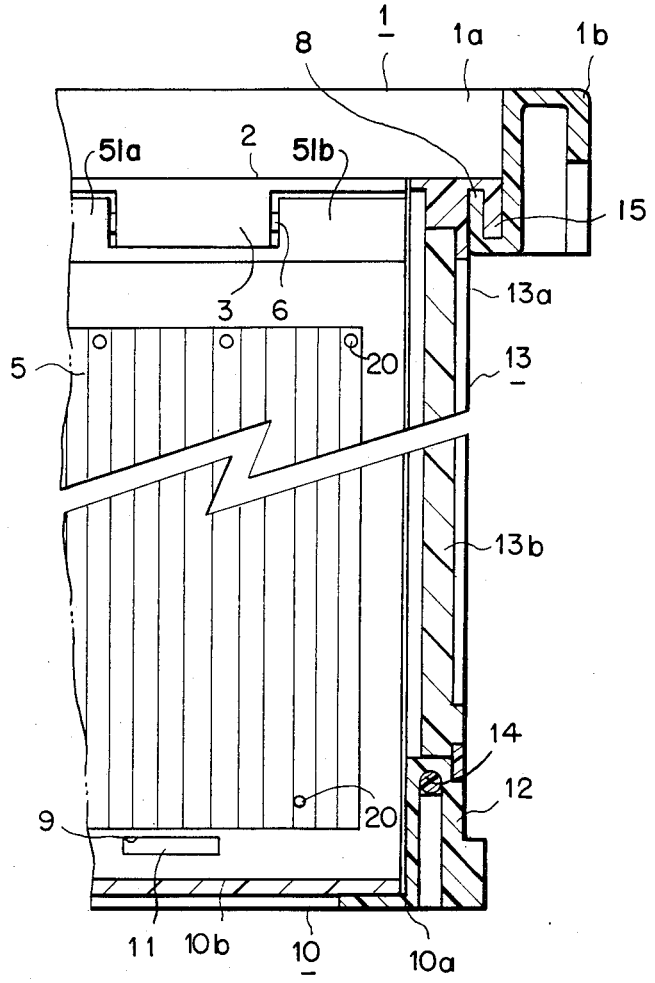
FIG. 6 is an enlarged sectional view taken along a line VI—VI in FIG. 1.

The frame 1 has an inverted U-shaped cross-section and is provided with a pair of flanges 2·2 horizontally projected at the insides of the longer sides 1*a*·1*a* thereof. At the lower side of each flange 2, as illustrated in FIGS. 5 and 6, a plurality of bosses 3 are integrally provided at suitable intervals in the longitudinal direction of the flange 2. The frame 1 is also provided with upwardly bent edges 8, as shown in FIG. 6, at the insides of the shorter sides 1*b*·1*b* thereof.

Each end plate 13 is provided with a downwardly bent edge 15, as shown in FIG. 6, at the upper side thereof to be engagable with the bent edge 8 of the frame 1 so that each end plate 13 is detachably connected to the shorter side 1*b* of the frame 1. Each end plate 13 is also provided with suitably spaced bosses 131, as shown in FIG. 7, at the lower side thereof.

Each side plate 5 is provided at the upper side thereof, as illustrated in FIGS. 5 and 6, with a plurality of pairs of bosses 51*a*·51*b* corresponding to the bosses 3 of the frame 1, and each pair of bosses 51*a*·51*b* are pivoted to the corresponding boss 3 by a pivot shaft 6 so that each side plate 5 is rotatably and detachably connected to the longer side 1*a* of the frame 1. Each side plate 5 is also provided with a plurality of openings 9, as illustrated in FIGS. 4 and 6, at the lower side thereof.

Figure 7:
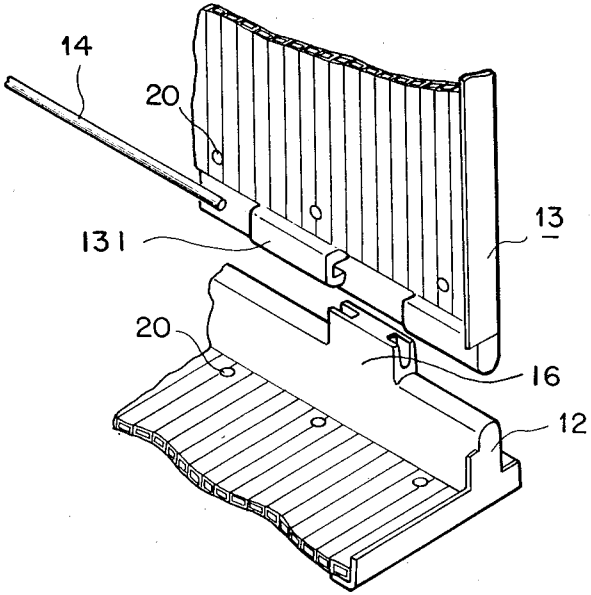
FIG. 7 is an exploded perspective view showing the relation of an end plate and a bottom plate.
Figure 9:
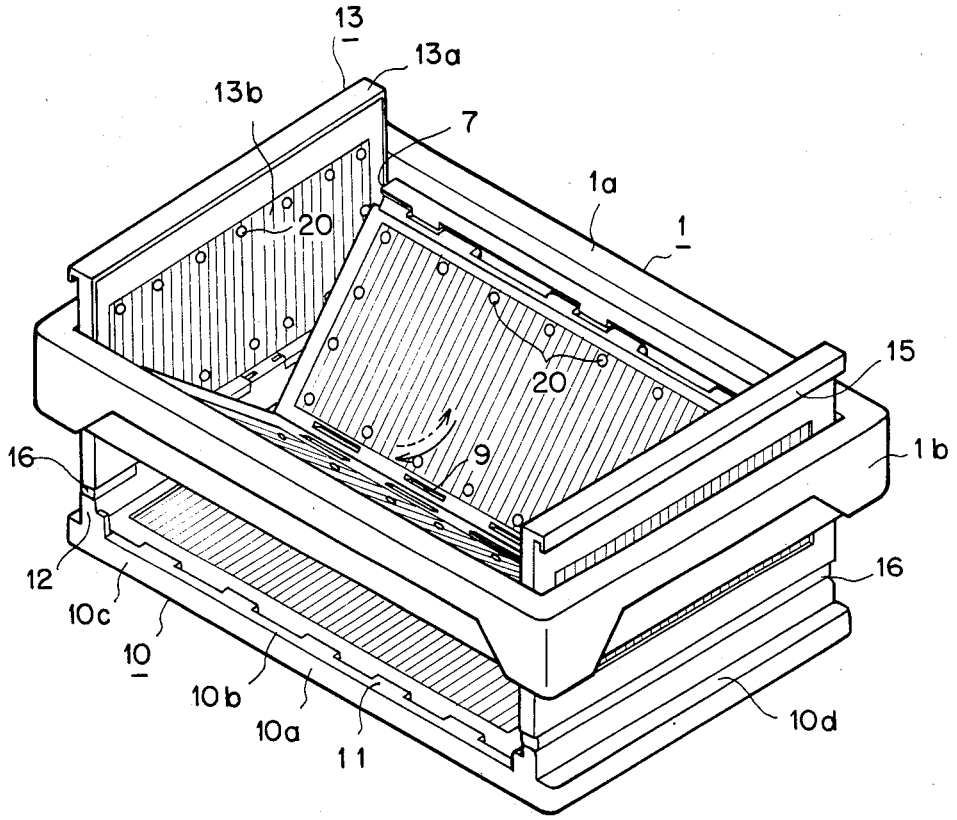
FIG. 9 is a perspective view showing the state of assembling or folding of the container.
Figure 12:
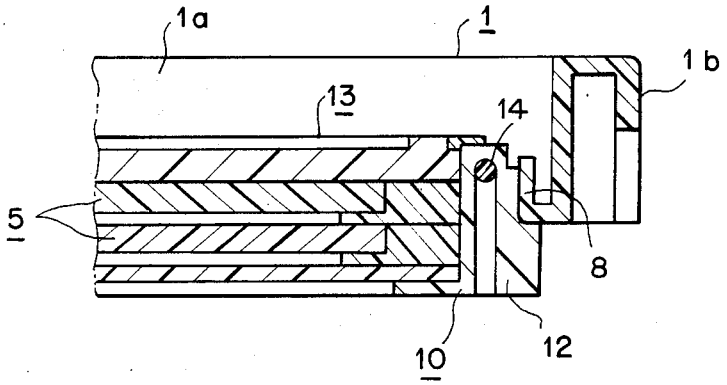
FIG. 12 is an enlarged sectional view taken along a line XII—XII in FIG. 10.

The bottom plate 10 is provided with studs 12, as illustrated in FIGS. 6 and 7, at the shorter sides 10*b*·10*b* thereof. The height and width of each stud 12 are determined such that the stud 12 can fit in the spacing 7 between the end of flange 2 and the edge 8 as illustrated in FIG. 12. Each stud 12 is integrally formed with suitably spaced bosses 16 to be fit into the spacing between the adjacent pair of bosses 131 of the end plate 13 and rotatably connected therewith by a supporting shaft 14.

Figure 4:
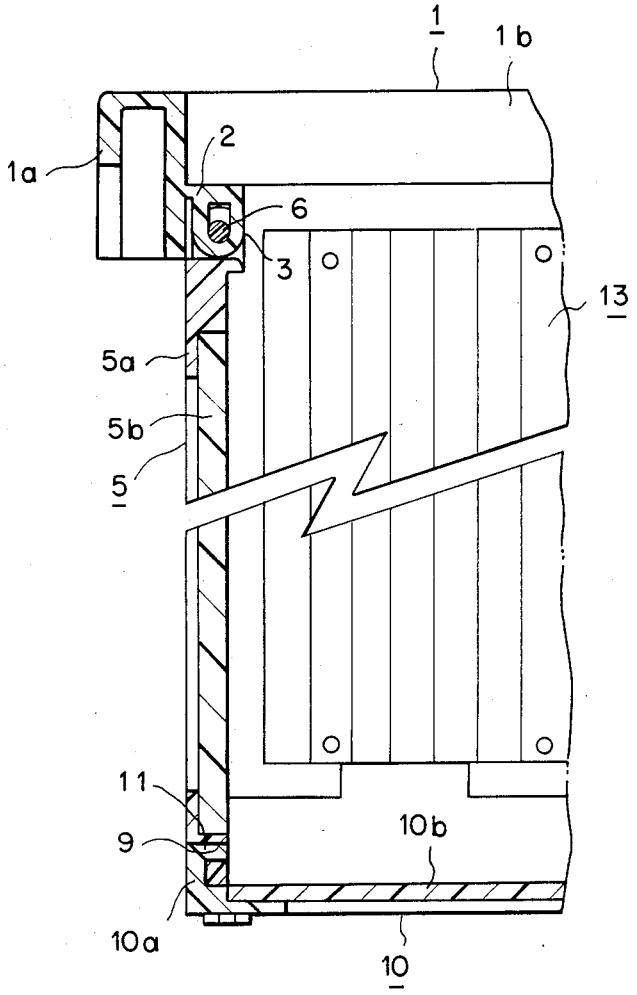
FIG. 4 is an enlarged sectional view taken along a line IV—IV in FIG. 1.

The bottom plate 10 is also provided with a plurality of inwardly bent hooks 11, as shown in FIGS. 4 and 6, at each longer side 10*a* thereof to be inserted into the openings 9 of the side plate 5 so that each side plate 5 is detachably connected to the bottom plate 10.

Figure 8:
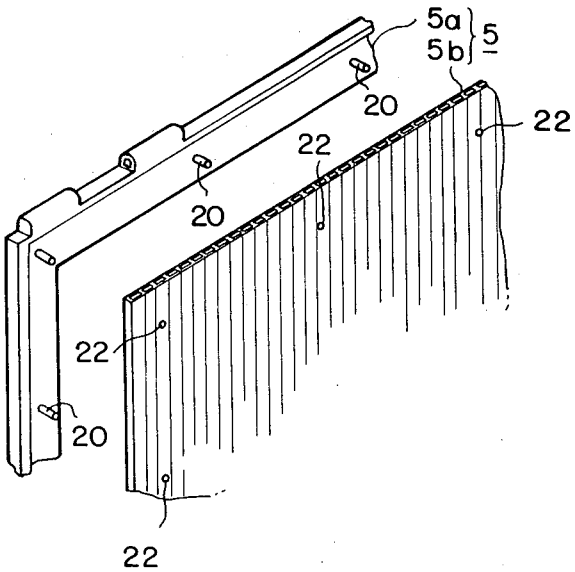
FIG. 8 is an exploded perspective view showing the relation of a frame part and a flat part of a side plate.

Each of side plates 5, bottom plate 10 and end plates 13 is comprised of a frame part 5*a*,10*a*,13*a* and a partitioned hollow flat part 5*b*,10*b*,13*b*. As illustrated in FIG. 8, the frame part 5*a* is, for example, provided with a plurality of pins 20 along the inner periphery thereof while a plurality of corresponding holes 22 are formed on the flat part 5*b*. The pins 20 of the frame part 5*a* are inserted through the holes 22 of the flat part 5*a* and the front ends of the pins 20 protruding from the holes 22 are deformed to tightly hook the flat part 5*b* onto the frame part 5*a* by heat pressing. The flat parts 10*b*·13*b* of the bottom plate 10 and end plates 13 are hooked to the frame parts 10*a*·13*a* thereof in the same manner.

The frame parts 5*a*·10*a*·13*a*, the flat parts 5*b*·10*b*·13*b* and the shafts 6·14 are formed by the same synthetic resin such as polypropylene resin or ABS resin, which contributes to retreatment of resin when containers are exploded.

The ways of assembling and folding the container will now be described with reference to FIGS. 9 through 12.

First, to fold the container illustrated in FIG. 1, hooks 11 of the bottom plate 10 are disengaged from the openings 9 of the side plates 5, and then the lower sides of the side plates 5 are rotated inwardly to be leveled beneath the flanges 2 of the upper frame 1. Thereafter, after disengaging edges 15 of the end plates 13 from the edges 8 of the frame 1, the upper frame 1 is moved down toward the bottom plate 10 while maintaining each side plate 5 to be positioned in the spacing 7 between the end of flange 2 and the edge 8 of the frame 1. Then, after fitting studs 12 into the spacings 7, the upper sides of the end plates 13 are rotated inwardly for overlapping the end plates 13 above the flanges 2 of the upper frame 1. Thus, the container is folded as illustrated in FIG. 10.

Figure 10:
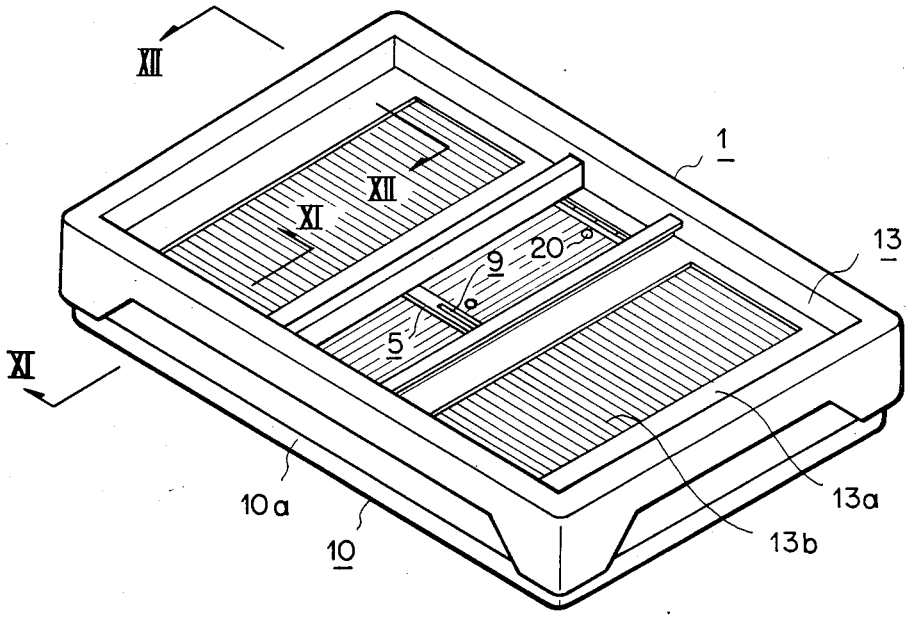
FIG. 10 is a perspective view showing a folded container.
Figure 11:
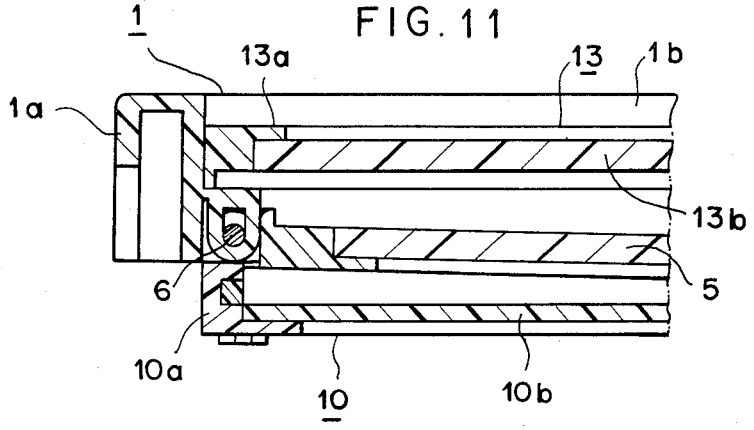
FIG. 11 is an enlarged sectional view taken along a line XI—XI in FIG. 10.

On the contrary, to assemble the container illustrated in FIG. 10, the upper sides of the end plates 13 are rotated to the vertical direction. Then, while engaging the end plates 13 with the spacings 7, the upper frame 1 is raised upwardly to cause the edges 15 of the end plates 13 to engage with edges 8. At this state, after rotating the lower sides of the side plates 5 outwardly, hooks 11 of the bottom plate 10 are fitted into the openings 9 of the side plates 5. At this stage, the upper frame 1 and the bottom plate 10 are maintained spaced apart, and since the end surfaces of the side plates 5 contact the inner surfaces of both ends of the end plate 13, the container is maintained a box shape.

What we claim is:

1. A foldable container, comprising:

an upper rectangular frame wherein said frame is provided with a pair of flanges on one pair of opposed inner sides and upwardly bent edges on the remaining pair of opposed inner sides;

a rectangular bottom plate having studs insertable into opposing sides of said upper frame;

a pair of side plates, the upper end of each of said side plates being rotatably connected to a corresponding flange of said upper frame, and the lower end of each side plate being detachably engageable with said bottom plate;

wherein each side plate is provided with a plurality of openings at the lower side thereof, and said bottom plate is provided with a plurality of inwardly protruded bosses to be inserted through said openings of each side plate; and a pair of end plates, the upper end of each of said end plates being detachably engageable with said frame and the lower end of each end plate being detachably engageable with said studs of said bottom plate;

wherein each side of said end plate is fit into a spacing between side edges of said flanges and an adjacent inner side surface of said frame, and each end plate is provided with a downwardly bent edge at the upper end thereof to be engageable with said bent edge of the frame.

2. The foldable container according to claim 1 wherein at least one of said side plates, end plates and bottom plate is comprised of a frame part and a flat part arranged to be hooked to the frame part by heat pressing.

3. The foldable container according to claim 2 wherein said frame part is provided with a plurality of pins protruded inwardly, and said flat part is provided with a plurality of holes to receive said pins of the frame part.

4. The foldable container according to claim 2 wherein said flat part comprises a partitioned hollow member.

5. The foldable container according to claim 2 wherein said frame part and said flat part are formed by the same synthetic resin.

* * * * *